US007394198B2

(12) United States Patent
Song et al.

(10) Patent No.: US 7,394,198 B2
(45) Date of Patent: Jul. 1, 2008

(54) PLASMA DISPLAY PANEL PROVIDED WITH ELECTRODES HAVING THICKNESS VARIATION FROM A DISPLAY AREA TO A NON-DISPLAY AREA

(75) Inventors: Young-Hwa Song, Suwon-si (KR); Seung-Heon Oh, Suwon-si (KR); Chang-Seok Rho, Suwon-si (KR); Cheol-Hee Moon, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 554 days.

(21) Appl. No.: 10/960,528

(22) Filed: Oct. 8, 2004

(65) Prior Publication Data

US 2005/0077823 A1 Apr. 14, 2005

(30) Foreign Application Priority Data

Oct. 9, 2003 (KR) ..... 10-2003-0070205

(51) Int. Cl.
*H01J 17/49* (2006.01)

(52) U.S. Cl. ..... 313/583; 313/582; 313/584; 313/585

(58) Field of Classification Search ..... 313/582–587; 315/169.1, 169.4; 345/37, 41, 60, 71
See application file for complete search history.

(56) References Cited

U.S. PATENT DOCUMENTS

| | | | |
|---|---|---|---|
| 5,541,618 | A | 7/1996 | Shinoda |
| 5,661,500 | A | 8/1997 | Shinoda et al. |
| 5,663,741 | A | 9/1997 | Kanazawa |
| 5,674,553 | A | 10/1997 | Shinoda et al. |
| 5,724,054 | A | 3/1998 | Shinoda |
| 5,786,794 | A | 7/1998 | Kishi et al. |
| 5,952,782 | A | 9/1999 | Nanto |
| RE37,444 | E | 11/2001 | Kanazawa |

(Continued)

FOREIGN PATENT DOCUMENTS

| | | |
|---|---|---|
| JP | 02-148645 | 6/1990 |

(Continued)

OTHER PUBLICATIONS

"*Final Draft International Standard*", Project No. 47C/61988-1/Ed. 1; Plasma Display Panels—Part 1: Terminology and letter symbols, published by Internationl Electrotechnical Commission, IEC. in 2003, and Apendix A—Description of Technology, Annex B—Relationship Between Voltage Terms And Discharge Characteristics; Annex C—Gaps and Annex D—Manufacturing.

*Primary Examiner*—Mariceli Santiago
(74) *Attorney, Agent, or Firm*—Robert E. Bushnell, Esq.

(57) ABSTRACT

A plasma display panel that has electrode extending to a periphery thereof with a thickness and width that varies from the thickness and width of other electrode portions to enhance electrode resistance efficiency and discharge characteristics. That is, the electrodes in the display extend through a display area where visible images are generated into a non-display area around the display area where a connection to a driving circuit is made. The electrodes are designed to have varying widths and thicknesses that vary depending on whether the electrode is inside the display area or is outside the display area.

22 Claims, 5 Drawing Sheets

U.S. PATENT DOCUMENTS

| | | | | |
|---|---|---|---|---|
| 6,411,035 | B1 * | 6/2002 | Marcotte | 313/585 |
| 6,452,333 | B1 * | 9/2002 | Torisaki et al. | 313/586 |
| 6,469,441 | B1 * | 10/2002 | Choi | 313/583 |
| 6,501,221 | B1 * | 12/2002 | Kim et al. | 313/583 |
| 6,548,962 | B1 * | 4/2003 | Shiokawa et al. | 315/169.4 |
| 6,630,916 | B1 | 10/2003 | Shinoda | |
| 6,707,436 | B2 | 3/2004 | Setoguchi et al. | |
| 6,787,992 | B2 * | 9/2004 | Chuman et al. | 313/505 |
| 6,864,638 | B2 * | 3/2005 | Ishihara et al. | 315/169.3 |
| 7,176,629 | B2 * | 2/2007 | Jang | 313/583 |
| 2002/0070664 | A1 * | 6/2002 | Terao et al. | 313/582 |
| 2002/0089285 | A1 * | 7/2002 | Nishiki et al. | 313/583 |
| 2004/0056595 | A1 * | 3/2004 | Shiokawa et al. | 313/582 |

FOREIGN PATENT DOCUMENTS

| | | | | |
|---|---|---|---|---|
| JP | 2845183 | | | 10/1998 |
| JP | 2917279 | | | 4/1999 |
| JP | 2001-043804 | | | 2/2001 |
| JP | 2001084908 | A | * | 3/2001 |
| JP | 2001-325888 | | | 11/2001 |
| JP | 2003-068216 | | | 3/2003 |
| JP | 2003-123654 | | | 4/2003 |
| JP | 2003173152 | A | * | 6/2003 |
| JP | 2005071981 | A | * | 3/2005 |
| KR | 1019990008672 | A | | 2/1999 |

* cited by examiner

*FIG.* 1

*FIG.* 6
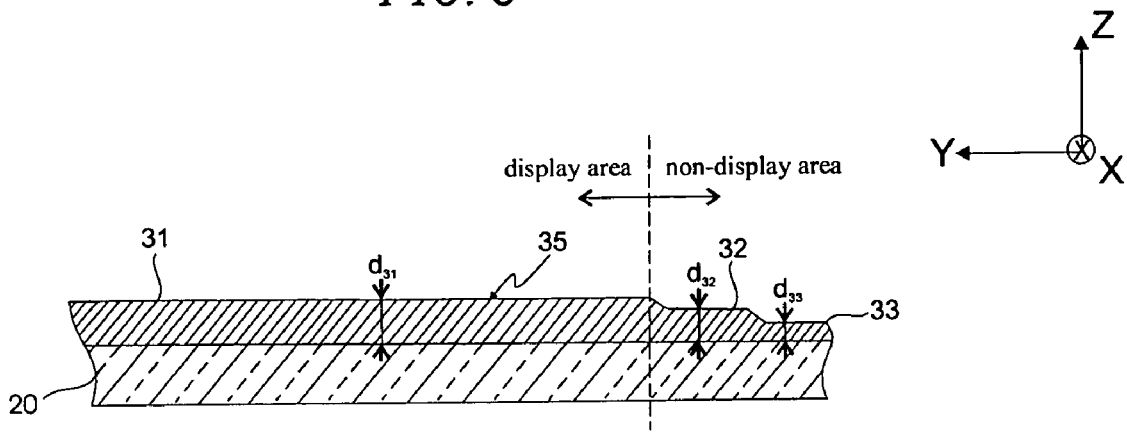

PLASMA DISPLAY PANEL PROVIDED WITH ELECTRODES HAVING THICKNESS VARIATION FROM A DISPLAY AREA TO A NON-DISPLAY AREA

CLAIM OF PRIORITY

This application makes reference to, incorporates the same herein, and claims all benefits accruing under 35 U.S.C. §119 from an application entitled PLASMA DISPLAY PANEL filed with the Korean Industrial Property Office on 9 Oct. 2003 and there duly assigned Serial No. 10-2003-0070205.

BACKGROUND OF THE INVENTION

1. Field of the Invention

The present invention relates to a plasma display panel, and in particular, to an electrode structure at the periphery of the plasma display panel to enhance the characteristics of electrode terminals.

2. Description of Related Art

Generally, a plasma display panel (referred to hereinafter simply as the "PDP") is a display device which displays images based on plasma discharge. When voltages are applied to electrodes formed at substrates of the PDP, a plasma discharge is made between the electrodes while generating ultraviolet rays. The ultraviolet rays excite phosphor layers formed in a predetermined pattern, thereby displaying the desired images. The PDPs are largely classified into an AC type, a DC type, and a hybrid type.

The plasma display generally has several sets of electrodes running across the display and to the edge of the display where the electrodes are connected to power and driving circuits. Often, the thickness of the electrodes, the width of the electrodes and the spacing between the electrodes is uniform both inside the display region and outside the display region. This can be problematical and inefficient as there is limited contact area to external drivers and there can be interference between neighboring lines. Therefore, what is needed is an improved and more efficient design for the electrodes in a PDP.

SUMMARY OF THE INVENTION

It is therefore an object of the present invention to provide an improved design for a PDP.

It is also an object of the present invention to provide an improved design for the electrodes in the PDP.

These and other objects can be achieved by a PDP that varies the thickness and/or width of the electrodes located at a periphery of the panel compared to the thickness and width of the electrodes in the display area to enhance the characteristic of electrode terminals. The PDP includes first and second substrates facing each other, and first and second electrodes formed on the first and the second substrates, respectively. The first and the second electrodes cross each other, and a display area is formed within the overlapped area of the first and the second electrodes. At least one of the first and the second electrodes is designed to have a different thickness inside the display area where visible images are generated versus outside the display area.

The electrodes are designed to have varying widths depending on the location, i.e., whether inside or outside the display area, and the thickness of the electrodes becomes greater as the width of the electrodes is enlarged.

The portion of the first electrode located outside the display area has a thickness greater than the thickness of the portion of the first electrode located inside the display area. The portion of the second electrode located outside the display area has a thickness smaller than the thickness of the portion of the second electrode located inside the display area.

The first electrode has a transparent electrode and a bus electrode formed along one side periphery of the transparent electrode, and the portion of each bus electrode located outside the display area has a thickness greater than the thickness of the portion of the bus electrode located inside the display area. The portion of the bus electrode located outside the display area has a width larger than the width of the portion of the bus electrode located inside the display area.

The ratio d/W of the thickness d of the bus electrode to the width W thereof is in the range of 1/50 to 1/5 for all locations of the electrode. Thus, when an electrode is made wider, it is also preferably made commensurately thicker so the thickness of d/W remains essentially the same. The bus electrode of the first electrode is preferably formed by offset printing.

The first electrodes include sustain and scanning electrodes formed opposite to each other, and each sustain electrode has an effective portion located inside the display area with a thickness, and a terminal portion extended from the effective portion and formed outside the display area with a thickness greater than the thickness of the effective portion.

The first electrodes have sustain and scanning electrodes formed opposite to each other, and each scanning electrode has an effective portion located inside the display area with a thickness, an interconnection portion extended from the effective portion and located close to the edge of the display area, and a terminal portion extended from the interconnection portion to the periphery of the substrate with a thickness greater than the thickness of the effective portion. The effective portion, the interconnection portion, and the terminal portion of the scanning electrode are each made to be sequentially wider.

The second electrode has an effective portion located inside the display area with a thickness, an interconnection portion extended from the effective portion and located close to the boundary of the display area, and a terminal portion extended from the interconnection portion to the periphery of the substrate with a thickness smaller than the thickness of the effective portion.

The terminal portion of the second electrode has a width smaller than the width of the effective portion, and the thickness of the electrode becomes thinner as the width of the electrode is narrowed.

The effective portion, the interconnection portion, and the terminal portion of the second electrode are each made to be sequentially narrower. The ratio d/W of the thickness of the second electrode to the width thereof is in the range of 1/50 to 1/5 for all portions of the display. The second electrode may be formed by offset printing.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein:

FIG. 6 is a partial sectional view of the second substrate of the PDP taken along the VI-VI' line of FIG. 5.

DETAILED DESCRIPTION OF THE INVENTION

Figure 1:
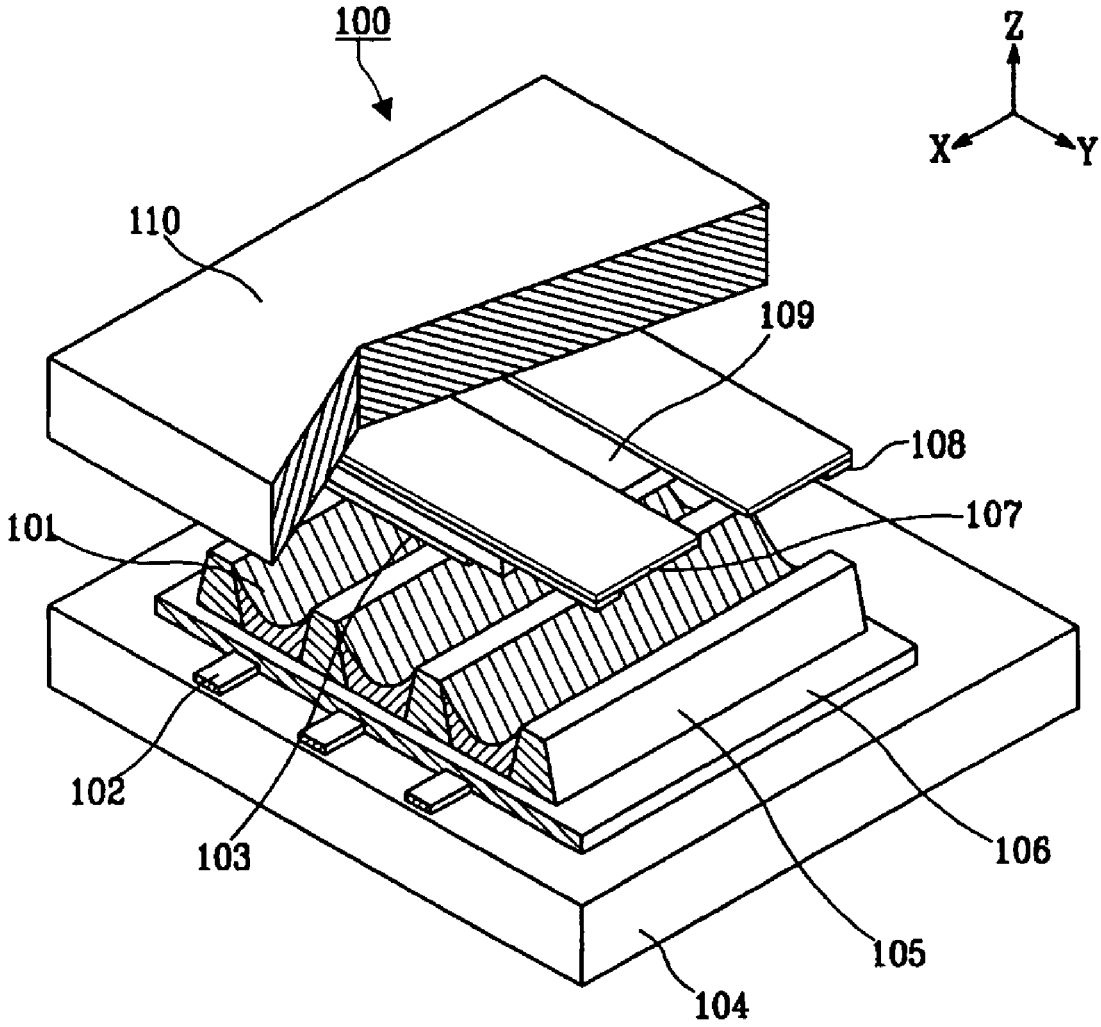
FIG. 1 is an exploded perspective view of a PDP.

FIG. 1 is an exploded perspective view of an AC PDP 100. As illustrated in FIG. 1, the PDP 100 includes a bottom substrate 104, address electrodes 102 formed on the bottom substrate 104, a dielectric layer 106 formed on the bottom substrate 104 and covering the address electrodes 102, a plurality of barrier ribs 105 formed on the dielectric layer 106 to uphold the discharge space and prevent inter-cell cross talk, and phosphor layers 101 formed on the barrier ribs 105.

Sustain electrodes 107 and scanning electrodes 108 are formed on a top substrate 110 while proceeding perpendicular to the address electrodes 102 formed on the bottom substrate 104. A dielectric layer 109 and a protective layer 103 cover the sustain electrodes 107 and the scanning electrodes 108.

With the above-structured PDP 100, an address discharge is made between the address and the scanning electrodes 102 and 108 under the application of driving voltages thereto, thereby forming wall charges within the discharge cells. Alternating current signals are alternately applied to the sustain electrodes 107 and the scanning electrodes 108 corresponding the selected discharge cells, thereby making the sustain discharge.

Meanwhile, the scanning and the sustain electrodes for the AC PDP are mainly formed with indium oxide ($In_2O_3$), and hence are called indium tin oxide (ITO) electrodes. The ITO electrodes are transparent to visible light and are evenly formed on the large-sized panel with excellent affinity with the neighboring materials. However, as the ITO electrodes have a relatively low conductivity. Bus electrodes are thus formed along the one-sided peripheries of the ITO electrodes with Ag or Cr—Cu—Cr to achieve the required electrical conductivity. The bus electrodes extend to the periphery of the panel to receive the driving voltage. The address electrodes are mainly formed with a high conductive Ag paste material.

As it is required for the bus electrodes and the address electrodes to have a narrow line width of 70-80 μm, they are mainly formed by the technique of screen printing, photolithography, lift-off or thin film formation. With the various electrode formation techniques, the electrodes have an even thickness or width at the respective locations of the PDP even though the roles of the electrodes at different portions of the display differ. Consequently, in the case the line width of the electrodes formed around the periphery of the PDP connected to the driving circuit unit via an FPC-like connector is too small, the electrodes are liable to be over-heated or have a connection failure with the FPC-like electrical signal connection member. Furthermore, in the case the inter-electrode distance around the periphery of the PDP is too small compared to the electrode width, electrical interference between neighboring electrodes can occur.

Figure 2:
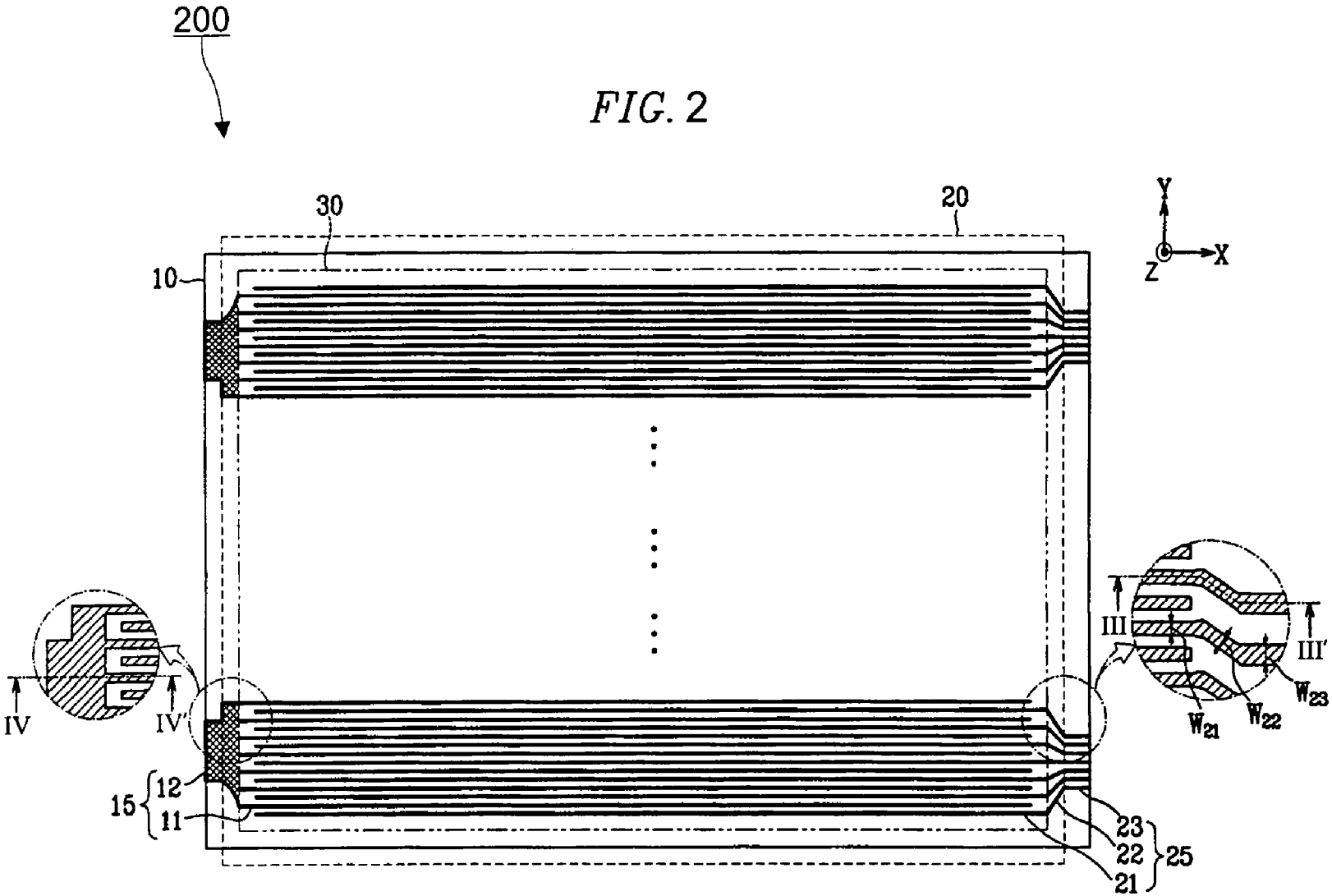
FIG. 2 is a schematic plan view of a PDP according to an embodiment of the present invention where display electrodes on a first substrate are emphasized.

Turning now to FIG. 2, FIG. 2 is a plan view of a PDP 200 according to an embodiment of the present invention, schematically illustrating emphasizing the arrangement of display electrodes 15 and 25 on a first substrate 10. As illustrated in FIG. 2, with the PDP 200, a plurality of display electrodes are formed on the first substrate 10 while extending in a direction (the direction of the x axis of the drawing). The display electrodes include sustain electrodes 15 and scanning electrodes 25 formed opposite to each other.

Meanwhile, a second substrate 20 faces the first substrate 10, and a plurality of address electrodes (not illustrated in FIG. 2) are formed on the surface of the second substrate 20 facing the first substrate 10 in the direction crossing the display electrodes (in the direction of the y axis of the drawing).

Pixels are formed at the respective crossed regions of the address electrodes and the display electrodes, and collectively form a display area 30. That is, the display area 30 may be defined as an area where the display and address electrodes 10 and 20 are overlapped with each other, and the address and the display electrodes cross each other to cause the display discharge due to the driving voltages applied to those electrodes. In other words, the display area 30 is the portion of the PDP 200 where visible images are formed.

A plurality of barrier ribs (not shown) is formed in the display area 30 to partition the respective pixels each with a separate discharge cell while supporting the two substrates 10 and 20. Phosphors are coated onto the inner wall of the discharge cells to generate visible rays.

The area externally surrounding the display area 30 may be defined as a "non-display area", not incurring any display discharge. Terminals for the respective electrodes are formed in the non-display area, and are connected to a driving circuit unit (not shown) via an electrical connector, such as a flexible printed circuit (FPC). Thus, in the non-display area, the electrodes have a different function than in the display area 30. In display area 30, the electrodes serve to produce the plasma and the visible images while in the non-display area, the electrodes serve as a connection to driving circuitry. Thus, it is efficient to design the electrodes in the non-display area differently than in the display area.

As illustrated in FIG. 2, the sustain electrodes 15 have effective portions 11 located within the display area 30, and terminal portions 12 formed to the outside of the display area 30 while being converged, and electrically connected with each other. One and the same voltage may be applied to the respective sustain electrodes 15.

The scanning electrodes 25 have effective portions 21 located within the display area 30, interconnection portions 22 extended from the effective portions 21 and located close to the edge of the display area 30, and terminal portions 23 extended from the interconnection portions 22 to the periphery of the first substrate 10 outside the display area 30. The interconnection portions 22 are converged toward the periphery of the first substrate 10 such that the distance between the neighboring scanning electrodes 25 becomes gradually smaller towards the periphery. Consequently, the distance between the neighboring terminal portions 23 connected to the ends of the interconnection portions 22 is smaller than the distance between neighboring effective portions 21. The converged terminal portions 23 are electrically connected to an FPC-like electrical signal connector.

A high voltage should be applied to the scanning electrodes 25 such that the display discharge can be made between the scanning and the sustain electrodes 25 and 15. In this respect, the resistance should be lowered in the terminal portions 23 to prevent the terminal portions 23 from being overheated. That is, it is preferable in preventing the overheating of the terminal portions 23 for the contact area of the terminal portions 23 to be increased. In this embodiment, the widths $W_{22}$ and $W_{23}$ of the electrode portions of the scanning electrodes 25 located outside the display area 30 are established to be larger than the width $W_{21}$ of the effective portions 21 located inside the display area 30. The electrode width is defined as a length measured from the top of each electrode to the bottom thereof in the direction proceeding vertical to the longitudinal side of the electrode (i.e., in the y direction).

More specifically, the effective portion 21, the interconnection portion 22, and the terminal portion 23 of each scanning electrode 25 may be designed to each have different widths. For instance, the electrode width $W_{22}$ of the interconnection portion 22 is designed to be larger than the electrode width $W_{21}$ of the effective portion 21, and the electrode width $W_{23}$ of the terminal portion 23 is designed to be larger than the electrode width $W_{22}$ of the interconnection portion 22.

Figure 3:
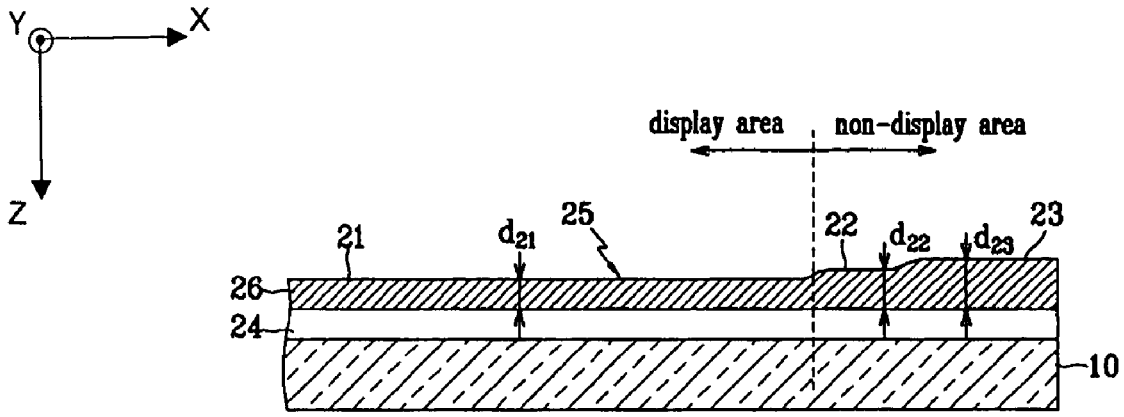
FIG. 3 is a partial sectional view of the first substrate of the PDP taken along the III-III' line of FIG. 2.

Turning now to FIG. 3, FIG. 3 illustrates a cross-section taken along III-III' of FIG. 2 illustrating a cross section of a scanning electrode 25 on first substrate 10 at a periphery of the PDP 200. As illustrated in FIG. 3, the scanning electrode 25 has a protrusion electrode 24 formed on the substrate 10 made with a material that is transparent to visible light, and a bus electrode 26 formed on the protrusion electrode 24. With the bus electrode 26, the thickness $d_{22}$ of the interconnection portion 22 located close to the boundary of the display area 30 is greater than the thickness $d_{21}$ of the effective portion 21 located inside the display area 30, and the thickness $d_{23}$ of the terminal portion 23 located close to the periphery of the substrate 10 is greater than the thickness $d_{22}$ of the interconnection portion 22. For instance, the effective portion 21, the interconnection portion 22, and the terminal portion 23 are sequentially enlarged in the thickness thereof to be 5 μm, 8 μm and 10 μm respectively for $d_{21}$, $d_{22}$ and $d_{23}$ respectively. The electrode thickness is defined as a length measured from the surface of the substrate overlaid with the electrode to the top of the electrode while proceeding vertical to the substrate (i.e., in the +z direction).

The width and the thickness of the electrode portions 26 located at the periphery of the substrate 10 are enlarged to thereby increase the contact area of the terminal portions with the FPC so that the terminal portions 23 are not overheated even under the application of a high voltage while having a good contact relationship. Compared to the address electrodes 35, as the scanning electrodes 25 are arranged in the display area together with the sustain electrodes by pairs, they are significantly angled at the interconnection portions 22 while forming inclined portions, but the thickness thereof at the interconnection portions 22 becomes greater than at the effective portions 21, thus preventing cutting disconnections thereof.

In an alternative embodiment, the width and the thickness of the interconnection portion 22 and the terminal portion 23 located outside the display area 30 may be designed to be equal to each other instead of making the thickness and width of the terminal portion 23 larger than the thickness and width of the interconnect portion 22. In this embodiment, the electrode width and thickness vary only at the edge of the effective portion 21.

Figure 4:
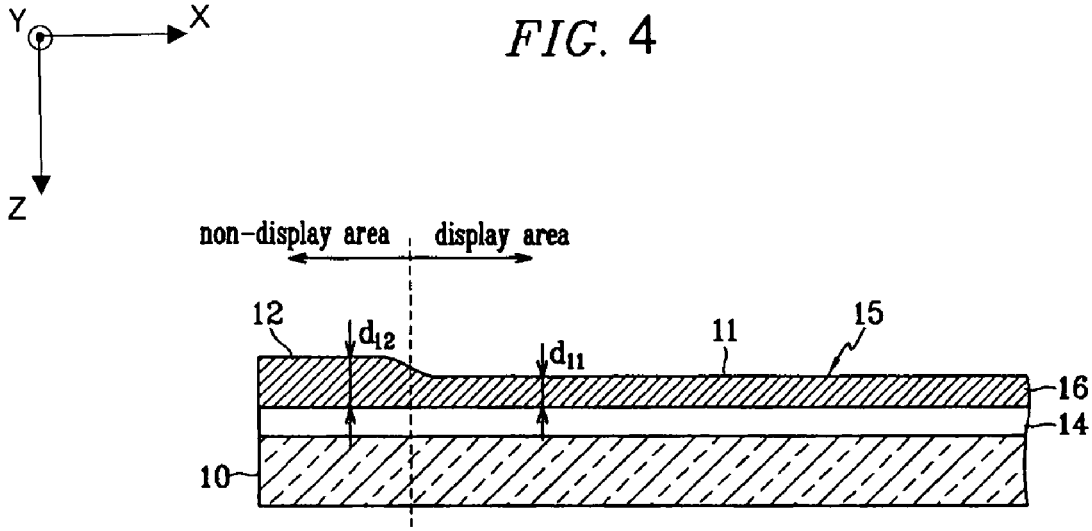
FIG. 4 is a partial sectional view of the first substrate of the PDP taken along the IV-IV' line of FIG. 2.

Turning now to FIG. 4, FIG. 4 illustrates a cross section taken along IV-IV' of FIG. 2 illustrating a cross section of a sustain electrode 15 on first substrate 10 at an edge of the PDP 200. As illustrated in FIG. 4, the sustain electrode 15 also has a protrusion electrode 14 formed on the first substrate 10 and made with a material that is transparent to visible light, and a bus electrode 16 is formed on the protrusion electrode 14. The bus electrode 16 has an effective portion 11 located inside the display area 30 with a thickness $d_{11}$, and a terminal portion 12 located outside the display area 30 with a thickness $d_{12}$ greater than the thickness $d_{11}$ of the effective portion 11.

With the sustain 15 and the scanning 25 electrodes forming the display electrodes, the ratio d/W of the electrode thickness d to the electrode width W is preferably designed to be between 1/50 and 1/5 for all portions of the electrode, both inside and outside the display area 30. When the ratio d/W is less than 1/50, the electrode is likely to be cut. In contrast, when the ratio d/W exceeds 1/5, the electrode width is so large compared to the electrode thickness that interference with neighboring electrodes can occur, or deterioration of the connection reliability of the electrodes to the FPC-like electrical connector occurs. Thus, when the thickness of the electrode varies with location, the electrodes are also preferably designed so that the width commensurately varies to keep the ratio the same.

Figure 5:
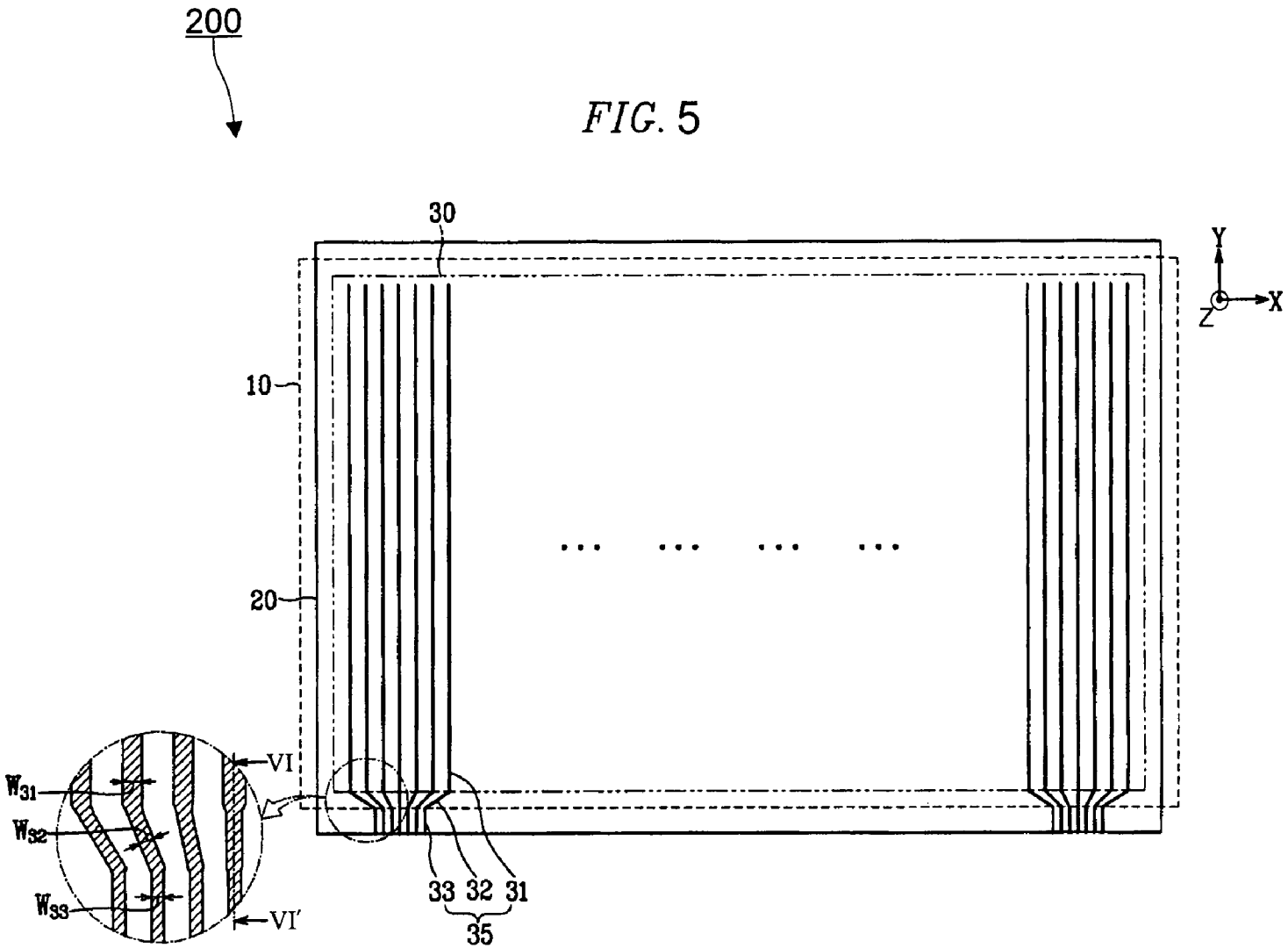
FIG. 5 is a schematic plan view of the PDP of FIG. 2 where address electrodes on a second substrate are emphasized.

Turning now to FIG. 5, FIG. 5 schematically illustrates the PDP 200 according to the present invention of FIG. 2 but with address electrodes 35 arranged on a second substrate 20 emphasized instead of the scanning and sustain electrodes on the first substrate as in FIG. 2. As illustrated in FIG. 5, each address electrode 35 has an effective portion 31 located inside the display area 30, an interconnection portion 32 extended from the effective portion 31 and located close to the boundary of the display area 30, and a terminal portion 33 extended from the interconnection portion 32 to the periphery of the second substrate 20. The interconnection portions 32 are converged while being gradually reduced in the distance between the electrode neighbors as they approach the periphery of the second substrate 20. The inter-electrode distance from the ends of the interconnection portions 32 to the terminal portions 33 is smaller than at the effective portions 31.

Address signal voltages are applied to the terminal portions 33 of the address electrodes 35 such that the desired cells are selected with respect to the scanning electrodes 25. It is preferable that interference does not occur between the neighboring address electrodes 35. That is, the distance between the terminal portions 33 of the address electrodes 35 is sufficiently increased with respect to the width of the terminal portions 33 such that signal interference does not occur even if a low voltage is applied to the terminal portions 33. In order to increase the distance between neighboring terminal portions 33 of address electrodes 35, the widths $W_{32}$ and $W_{33}$ of the interconnection portion 32 and the terminal portion 33 of the address electrodes 35 located outside the display area 30 are designed to be narrower than the width $W_{31}$ of the effective portion 31 of the address electrodes 35 located inside the display area 30.

Specifically, the effective portion 31, the interconnection portion 32, and the terminal portion 33 of each address electrode 35 are designed to have sequentially increasing widths. The electrode width $W_{32}$ of the interconnection portion 32 is smaller than the electrode width $W_{31}$ of the effective portion 31, and the electrode width $W_{33}$ of the terminal portion 33 is smaller than the electrode width $W_{32}$ of the interconnection portion 32.

Turning now to FIG. 6, FIG. 6 illustrates a cross-section taken along VI-VI' of FIG. 5 illustrating a cross section of an address electrode 35 on the second substrate 20 at a periphery of the PDP 200. As illustrated in FIG. 6, the thickness $d_{32}$ of the interconnection portion 32 located close to the edge of the display area 30 is thinner than the thickness $d_{31}$ of the effective portion 31 located inside the display area 30. The thickness $d_{33}$ of the terminal portion 33 located close to the periphery of the substrate 20 is thinner than the thickness $d_{32}$ of the interconnection portion 32. That is, the effective portion 31, the interconnection portion 32 and the terminal portion 33 are designed to have sequentially increasing thicknesses.

As described above, the electrodes are designed to have varying widths and thicknesses at different locations. That is, the portions of the address electrodes 35 located at the periphery of the panel have a narrow width and/or a thin thickness such that interference between the electrode neighbors does not occur at the interconnection portions 32 and at the terminal portions 33 where the distance between the electrode neighbors is smaller. In an alternative embodiment, the interconnection portion 32 and the terminal portion 33 located outside the display area 30 may be designed to have the same electrode thickness, and in this case, the electrode thickness is varied only between the inside of the display area 30 and the outside thereof.

Even with the respective address electrodes 35, the ratio d/W of the electrode thickness d to the electrode width W is preferably established to be between 1/50 and 1/5. When the ratio d/W is less than 1/50, the electrode is likely to be severed. By contrast, when the ratio d/W exceeds 1/5, the electrode width is too large compared to the electrode thickness so that the electrode neighbors interfere with each other, or the connection reliability of the electrodes to the FPC-like electrical connector deteriorates.

In this embodiment, the electrode structure of the PDP is explained based on the case in which it is controlled in a single driving procedure where the address electrodes are formed in a single direction, and the driving signals are applied in that direction. Alternatively, the electrode structure may be also applied to the case in that the PDP is controlled in a dual driving procedure where the address electrodes are formed in dual directions, and the driving signals are applied in both these directions.

The sustain electrodes 15, the scanning electrodes 25, and the address electrodes 35 may be formed using an offset printing technique. That is, an electrode pattern is formed at an intaglio printing plate, and ink is coated onto the electrode pattern, followed by blanket-printing and printing again to the substrate. With such an offset printing process, the electrode thickness and width can be easily controlled.

As described above, with the inventive plasma display panel, the electrode thickness and width are varied at the respective electrode terminal portions such that the electrode structure is well adapted to the characteristic of the terminals corresponding to the respective locations of the PDP. The reliability in the connection of the electrodes to the FPC-like electrical connector is enhanced while preventing the interconnection portions from being cut.

Although preferred embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims.

What is claimed is:

1. A plasma display panel, comprising:

first and second substrates facing each other; and first and second electrodes arranged on the first and the second substrates respectively, the first and the second electrodes crossing each other, wherein a display area is arranged within an overlapped area of the first and the second electrodes, the display area including a plurality of pixels, and at least one of the first and the second electrodes has a different thickness within the display area than outside the display area.

2. The plasma display panel of claim 1, wherein the electrodes have different widths inside the display area than outside the display area, the thicknesses of the electrodes being varied according to width.

3. A plasma display panel, comprising:

first and second substrates facing each other; and first and second electrodes arranged on the first and the second substrates respectively, the first and the second electrodes crossing each other, wherein a display area is arranged within an overlapped area of the first and the second electrodes, and at least one of the first and the second electrodes has a different thickness within the display area than outside the display area, wherein a portion of the first electrode located outside the display area being thicker than a portion of the first electrode located inside the display area.

4. The plasma display panel of claim 1 wherein a portion of the second electrode located outside the display area is thinner a portion of the second electrode located inside the display area.

5. The plasma display panel of claim 1, wherein the first electrode comprises a transparent electrode and a bus electrode arranged along one side of the transparent electrode, and a portion of each bus electrode located outside the display area being thicker than a portion of the bus electrode located inside the display area.

6. The plasma display panel of claim 5, wherein the portion of the bus electrode located outside the display area having a larger width than the portion of the bus electrode located inside the display area.

7. The plasma display panel of claim 5, wherein the ratio d/W of the thickness d of the bus electrode to the width W is between 1/50 and 1/5.

8. The plasma display panel of claim 5, wherein the bus electrode of the first electrode is produced by a process comprising offset printing.

9. The plasma display panel of claim 1, wherein the first electrodes comprise sustain and scanning electrodes arranged opposite to each other, and each sustain electrode has an effective portion located inside the display area with a first thickness, and a terminal portion extended from the effective portion and located outside the display area with a second thickness that is greater than the first thickness.

10. The plasma display panel of claim 1, wherein the first electrodes have sustain and scanning electrodes formed opposite to each other, and each scanning electrode has an effective portion located inside the display area with a first thickness, an interconnection portion extended from the effective portion and located close to an edge of the display area, and a terminal portion extended from the interconnection portion to a periphery of the substrate with a second thickness that is greater than the first thickness of the effective portion.

11. The plasma display panel of claim 10, wherein the effective portion, the interconnection portion, and the terminal portion of the scanning electrode are each made to be sequentially wider.

12. The plasma display panel of claim 1, wherein the second electrode has an effective portion located inside the display area with a first thickness, an interconnection portion extended from the effective portion and located close to an edge of the display area, and a terminal portion extended from the interconnection portion to the periphery of the substrate with a second thickness that is smaller than the first thickness.

13. The plasma display panel of claim 12, wherein the terminal portion of the second electrode has a first width that is smaller than a second width of the effective portion, and the thickness of the second electrode becomes thinner as the width of the second electrode becomes smaller.

14. The plasma display panel of claim 12, wherein the effective portion, the interconnection portion and the terminal portion of the second electrode are each made to be sequentially narrower.

15. The plasma display panel of claim 12, wherein the ratio d/W of the thickness of the second electrode to the width thereof is between 1/50 and 1/5.

16. The plasma display panel of claim 12, wherein the second electrode is produced by a process comprising offset printing.

17. A plasma display panel, comprising:

a first substrate and a second substrate facing the first substrate; and a plurality of first electrodes and a plurality of second electrodes arranged on the first and the second substrates respectively, the first and the second electrodes being essentially orthogonal to each other and overlapping each other, wherein a display area is arranged within an overlapped area of the first and the second electrodes, the display area includes a plurality of discharge cells, and each of at least one of the first and the second electrodes having both a different width and a different thickness within the display area than outside the display area.

18. The plasma display panel of claim 17, each of the at least one of the first and the second electrodes having a narrower width and a smaller thickness outside the display area than within the display area.

19. The plasma display panel of claim 18, the at least one of the first and the second electrodes being address electrodes.

20. A plasma display panel, comprising:

a first substrate and a second substrate facing the first substrate; and a plurality of first electrodes and a plurality of second electrodes arranged on the first and the second substrates respectively, the first and the second electrodes being essentially orthogonal to each other and overlapping each other, wherein a display area is arranged within an overlapped area of the first and the second electrodes, the display area includes a plurality of discharge cells, and each electrode of at least one of the first and the second electrodes includes an effective portion arranged within the display area and having a first width, an interconnection portion extended from the effective portion and arranged close to an edge of the display area and having a second width that is smaller than the first width, and a terminal portion extended from the interconnection portion to a periphery of one of said first and second substrates and having a third width that is smaller than the second width.

21. The plasma display panel of claim 20, the at least one of the first and the second electrodes being address electrodes.

22. The plasma display panel of claim 20, the effective portion of each of the at least one of the first and second electrodes has a first thickness, the interconnection portion of each of the at least one of the first and second electrodes has a second thickness that is less than the first thickness, and the terminal portion of each of the at least one of the first and second electrodes has a third thickness that is less than the second thickness.

* * * * *

Disclaimer 7,394,198 — Young-Hwa Song, Suwon-si (KR); Seung-Heon Oh, Suwon-si (KR); Chang-Seok Rho, Suwon-si (KR); Cheol-Hee Moon, Suwon-si (KR). PLASMA DISPLAY PANEL PROVIDED WITH ELECTRODES HAVING THICKNESS VARIATION FROM A DISPLAY AREA TO A NON-DISPLAY AREA. Patent dated July 1, 2008. Disclaimer filed June 7, 2010, by the assignee, Samsung SDI Co., Ltd.

Hereby enters this disclaimer to claims 1-22 of said patent.

*(Official Gazette, August 10, 2010)*